US007905444B2

(12) United States Patent
Chen

(10) Patent No.: US 7,905,444 B2
(45) Date of Patent: Mar. 15, 2011

(54) CARBON RIBBON SHAFT OF BARCODE PRINTER

(75) Inventor: Ching-Wen Chen, Taipei (TW)

(73) Assignee: TSC Auto ID Technology Co., Ltd., I-Lan Hsien (TW)

( * ) Notice: Subject to any disclaimer, the term of this patent is extended or adjusted under 35 U.S.C. 154(b) by 27 days.

(21) Appl. No.: 12/318,705

(22) Filed: Jan. 7, 2009

(65) Prior Publication Data

US 2009/0175668 A1 Jul. 9, 2009

(30) Foreign Application Priority Data

Jan. 7, 2008 (TW) ..... 97200324 U

(51) Int. Cl.
*B65H 75/24* (2006.01)

(52) U.S. Cl. ..... 242/571.3; 242/571.8; 242/573.7; 242/597.5

(58) Field of Classification Search .... 242/571.3–571.6, 242/571.8, 573.7, 573.9, 578.3, 599.4, 597.5
See application file for complete search history.

(56) References Cited

U.S. PATENT DOCUMENTS 4,084,762 A * 4/1978 Repp ..... 242/597.3
4,984,915 A * 1/1991 Tashiro et al. ..... 242/597.3
5,492,280 A * 2/1996 Corres et al. ..... 242/130
5,947,409 A * 9/1999 Corrigan, Jr. ..... 242/571.4
6,095,704 A * 8/2000 Jaeger et al. ..... 400/613
6,155,517 A * 12/2000 Lippold et al. ..... 242/571.5
6,206,323 B1 * 3/2001 Byars ..... 242/577
6,315,235 B1 * 11/2001 Breyer et al. ..... 242/422.4
7,506,834 B2 * 3/2009 Lenkl ..... 242/573.7

* cited by examiner

*Primary Examiner* — Sang Kim
(74) *Attorney, Agent, or Firm* — Rosenberg, Klein & Lee

(57) ABSTRACT

A carbon ribbon shaft is provided for a barcode printer and includes a shaft rod and at least one first rotation member and one second rotation member. The shaft rod has an end coupled to a housing of the barcode printer. The first and second rotation members are fit over the shaft rod. Arranged between inside of the first rotation member and the shaft rod is a resilient element that allows the first rotation member to effect resilient rotation with respect to the shaft rod. The first rotation member has an outer surface forming sliding-resistant resilient tabs. Arranged between inside of the second rotation member and the shaft rod is a resilient element that allows the second rotation member to effect resilient rotation with respect to the shaft rod. The second rotation member has an outer surface forming sliding-resistant resilient tabs. The surfaces of first and second rotation members receive a carbon ribbon roll of the barcode printer to fit thereon. With the resilient expansion of the sliding-resistant resilient tabs of the first and second rotation members, the carbon ribbon roll is securely fixed on the first and second rotation members to thereby form a carbon ribbon shaft assembly for a modularized carbon ribbon roll.

3 Claims, 4 Drawing Sheets

CARBON RIBBON SHAFT OF BARCODE PRINTER

BACKGROUND OF THE INVENTION

1. Field of the Invention

The present invention relates to a carbon ribbon shaft of a barcode printer, and in particular to a carbon ribbon shaft that functions to retain a carbon ribbon roll in a barcode printer and has sliding-resistant feature on a surface thereof for preventing the carbon ribbon roll from sliding/shifting.

2. The Related Arts

A conventional barcode printer uses a carbon ribbon in the form of a roll that is arranged inside the barcode printer for supplying carbon powders for printing of barcodes. Thus, the feeding operation of the carbon ribbon has must be in tight synchronization with the operation of a printing mechanism of the barcode printer in order to realize smooth printing operation.

The carbon ribbon roll for the conventional barcode printer is incapable to be set in tight engagement with the outer surface of a carbon ribbon shaft and thus the conventional carbon ribbon roll cannot maintain smooth and substantially synchronized feed of the carbon ribbon during the printing operation. Such a problem of unsmooth, and sometimes even jammed, supply of carbon ribbon in the course of barcode printing often results in defects of the quality of printed barcodes.

SUMMARY OF THE INVENTION

Thus, in view of the above discussed problems, the present invention is aimed to provide a carbon ribbon shaft for a barcode printer in order to solve the problem of fitting and securely fixing a carbon ribbon roll on the carbon ribbon shaft.

To achieve the above objective, the present invention provides a carbon ribbon shaft for securely fixing a carbon ribbon roll in order to ensure smooth and proper feed of a carbon ribbon to a barcode printer. In accordance with the present invention, the carbon ribbon shaft comprises a shaft rod and at least one first rotation member and one second rotation member. The shaft rod has an end coupled to a housing of the barcode printer. The first and second rotation members are fit over the shaft rod. Arranged between inside of the first rotation member and the shaft rod is a resilient element that allows the first rotation member to effect resilient rotation with respect to the shaft rod. The first rotation member has an outer surface forming sliding-resistant resilient tabs. Arranged between inside of the second rotation member and the shaft rod is a resilient element that allows the second rotation member to effect resilient rotation with respect to the shaft rod. The second rotation member has an outer surface forming sliding-resistant resilient tabs. The surfaces of first and second rotation members receive a carbon ribbon roll of the barcode printer to fit thereon. With the resilient expansion of the sliding-resistant resilient tabs of the first and second rotation members, the carbon ribbon roll is securely fixed on the first and second rotation members to thereby form a carbon ribbon shaft assembly for a modularized carbon ribbon roll.

The effectiveness of the carbon ribbon shat of barcode printers in accordance with the present invention is allowing a carbon ribbon roll to be set on the carbon ribbon shaft in a tightly engaged and sliding-resistant manner, in order to ensure smooth and proper feeding of the carbon ribbon and thus enhancing quality and stability of quality of barcode printing done by the barcode printers and the modularized arrangement between sliding-resistant tabs and the shaft by means of two rotation members ensures easy installation and cost reduction.

BRIEF DESCRIPTION OF THE DRAWINGS

The present invention will be apparent to those skilled in the art by reading the following description of a preferred embodiment thereof, with reference to the attached drawings, wherein.

DETAILED DESCRIPTION OF THE PREFERRED EMBODIMENT

Figure 1:
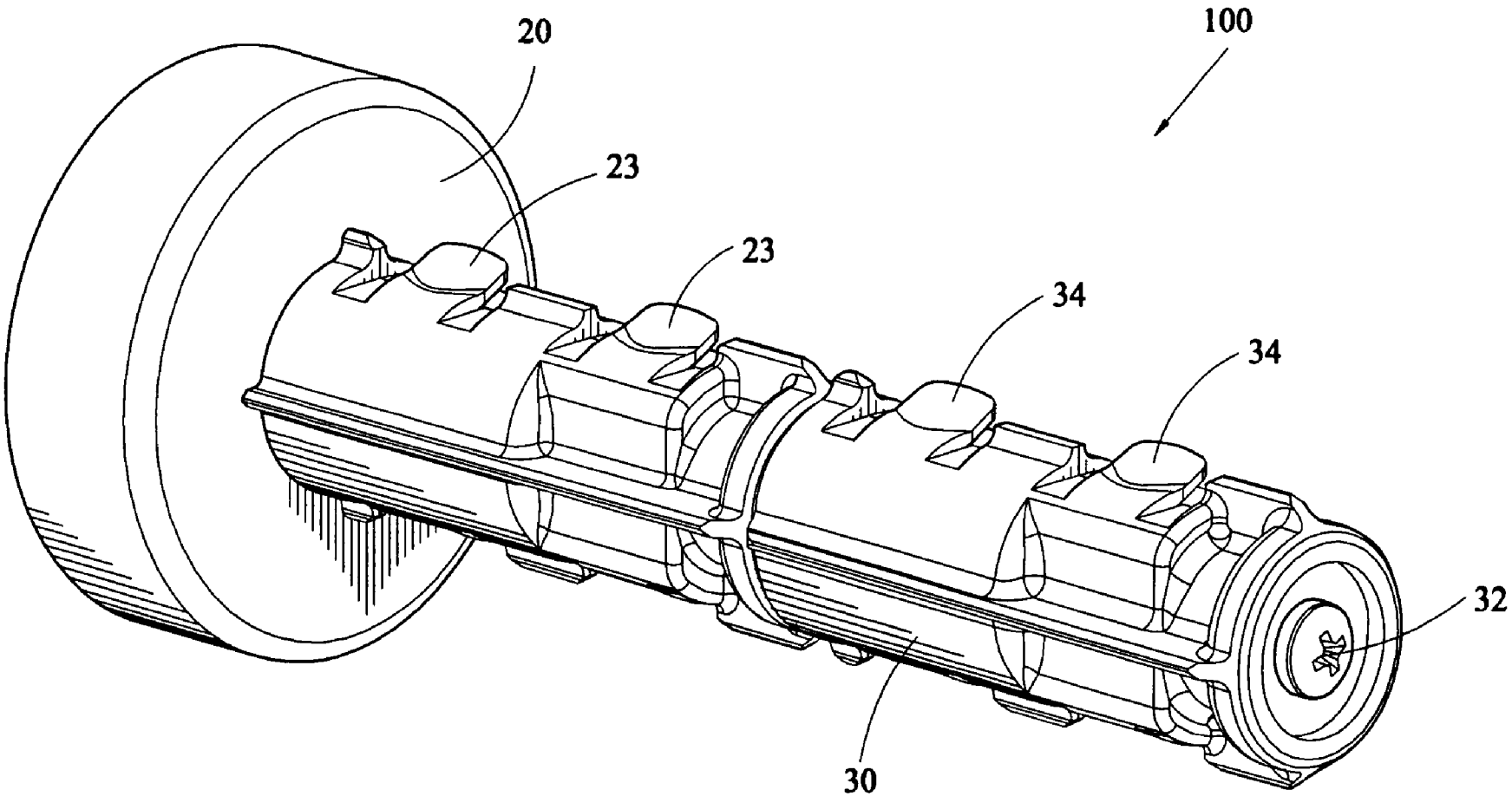
FIG. 1 is a perspective view of a carbon ribbon shaft constructed in accordance with the present invention for a barcode printer.
Figure 2:
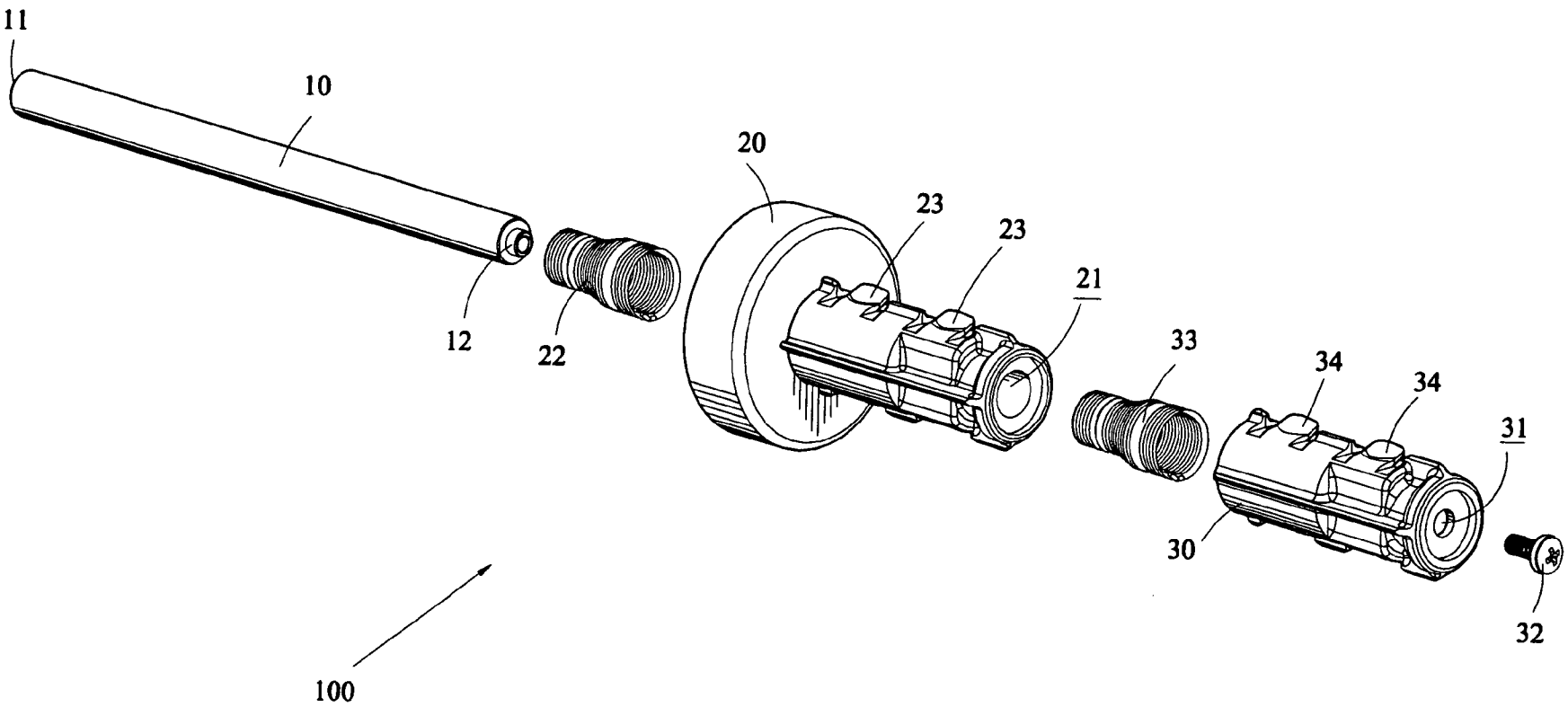
FIG. 2 is an exploded view of the carbon ribbon shaft in accordance with the present invention.
Figure 3:
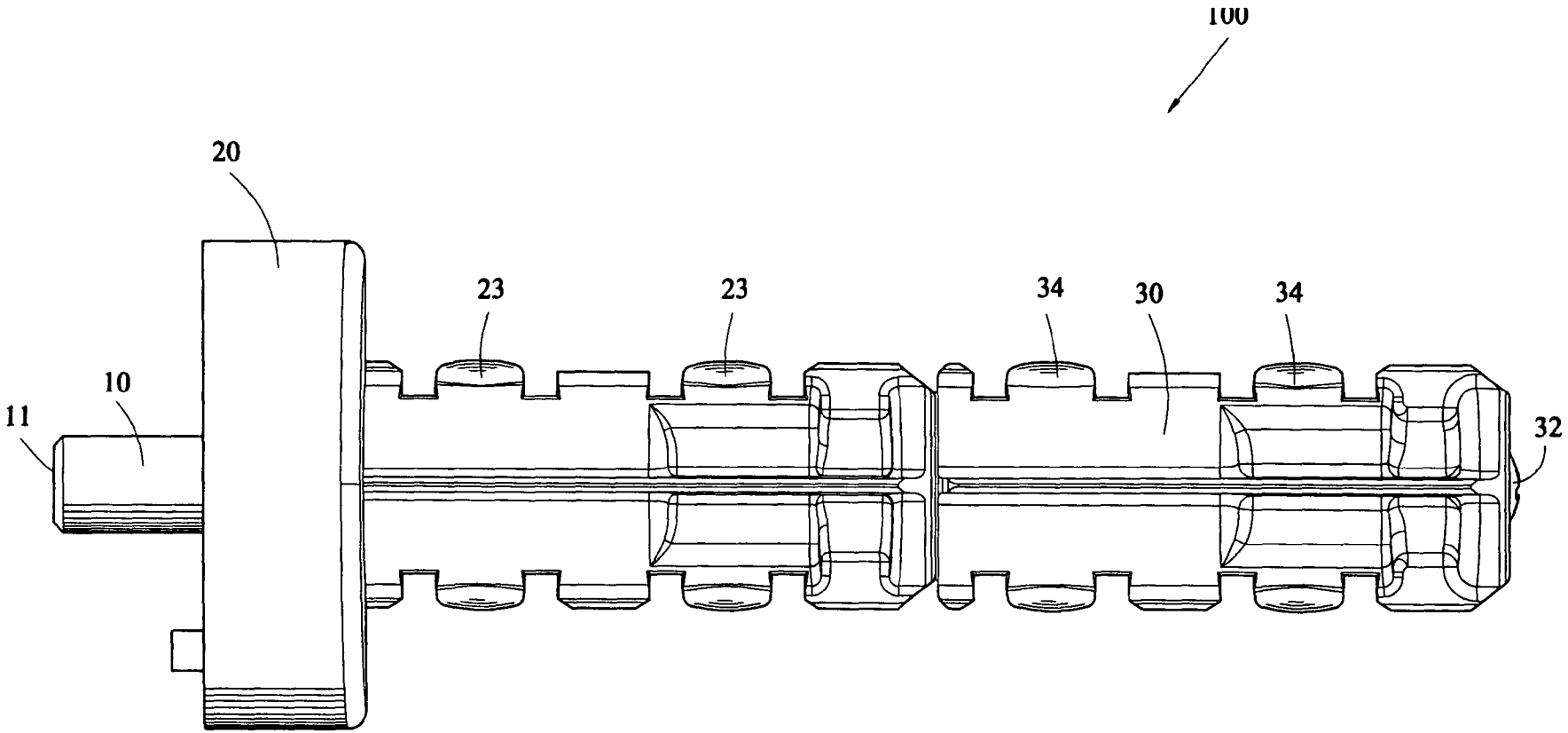
FIG. 3 is a side elevational view of the carbon ribbon shaft of the present invention.
Figure 4:
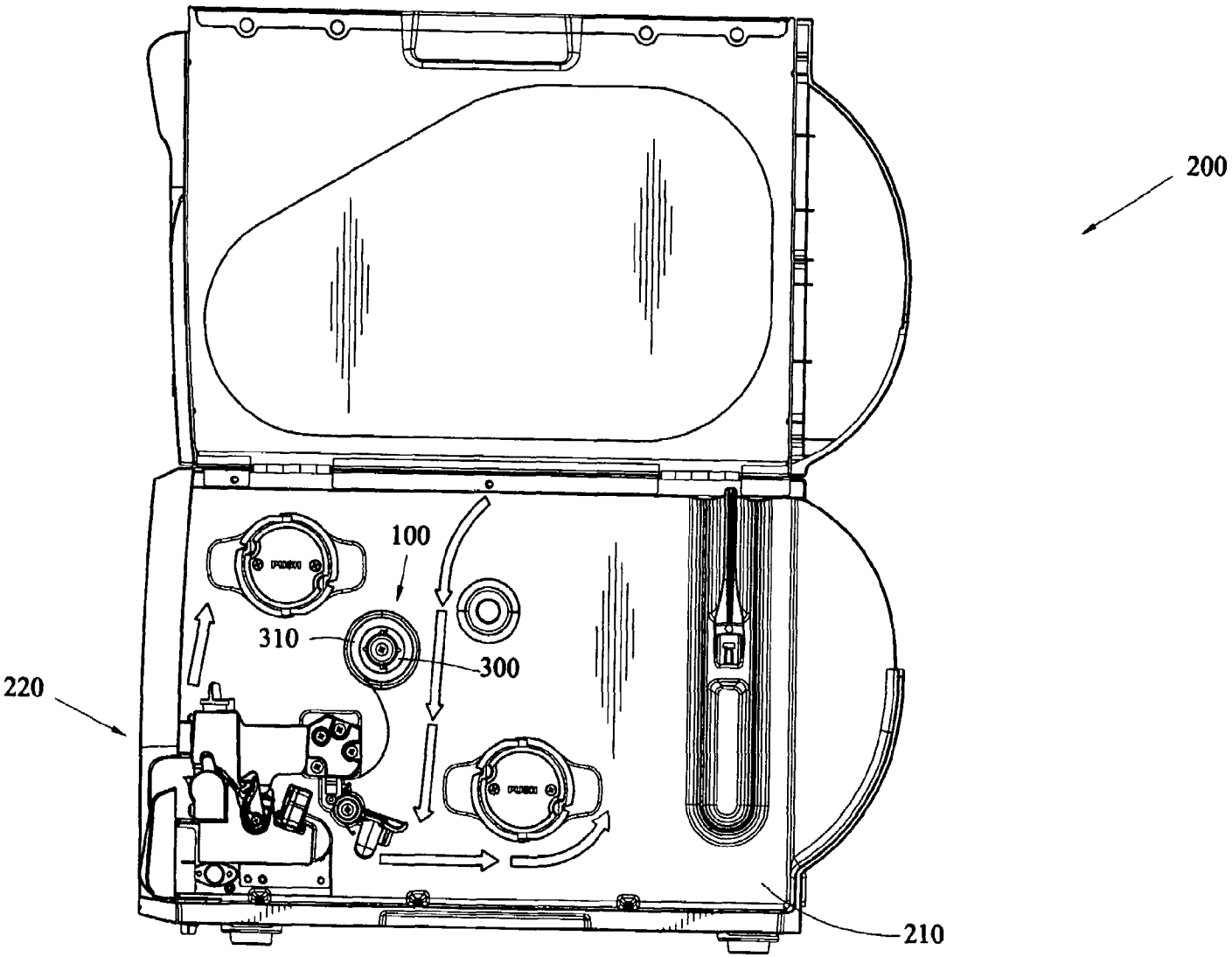
FIG. 4 illustrates an application of the carbon ribbon shaft of the present invention in a barcode printer.

With reference to the drawings and in particular to FIGS. 1-3, a carbon ribbon shaft constructed in accordance with the present invention, generally designated at 100, is provided for a barcode printer 200 (FIG. 4). The carbon ribbon shaft 100 comprises a shaft rod 10 having an end serving as a base section 11 for coupling to an inside surface of a housing 210 of the barcode printer 200, as shown in FIG. 4, and an opposite end forming at least one internally-threaded bore 12.

At least one first rotation member 20 forms a bore 21 for fitting over the base section 11 of the shaft rod 10 thereby mounting the first rotation member 20 to the end of the shaft rod 10. A first resilient element 22 is arranged inside the first rotation member 20 and located between inside of the first rotation member 20 and the shaft rod 10 in such a way that the first rotation member 20 is allowed to effect resilient rotation around the shaft rod 10. The first rotation member 20 has an outer surface on which plural sets of sliding-resistant resilient tabs 23 are provided. The structure between the sliding-resistant resilient tabs 23 and the first rotation member 20 can be of any desired construction and in the embodiment illustrated, the sliding-resistant resilient tabs 23 are integrally formed with the first rotation member 20.

At least one second rotation member 30 forms a bore 31 and is fit over the opposite end of the shaft rod 10 with the bore 31 substantially aligned with the internally-threaded bore 12 of the shaft rod 10. A threaded fastener 32, such as bolt or a screw, is inserted through the bore 31 and threaded with the internally-threaded bore 12 to secure the second rotation member 30 to the said opposite end of the shaft rod 10. A second resilient element 33 is arranged inside the second rotation member 30 and located between the second rotation member 30 and the shaft rod 10 in such a way that the second rotation member 30 is allowed to effect resilient rotation around the shaft rod 10. The second rotation member 30 has an outer surface on which plural sets of sliding-resistant resilient tabs 34 are provided. The structure between the sliding-resistant resilient tabs 34 and the second rotation member 30 can be of any desired construction and in the embodiment illustrated, the sliding-resistant resilient tabs 34 are integrally formed with the second rotation member 30.

Also referring to FIG. 4, the operation of the carbon ribbon shaft 100 of the present invention will be explained. The first rotation member 20 and the second rotation member 30 functions to receive a spool 310 of a carbon ribbon roll 300 to fit thereon and the resilient tabs 23 on the surface of the first rotation member 20 and the resilient tabs 34 on the surface of the second rotation member 30 are resiliently expanded to securely fix the spool 310 against sliding/shifting with respect to the carbon ribbon shaft 100 so that the carbon ribbon roll 300 is securely mounted to and fixed to the surfaces of the first and second rotation members 20, 30. Thus, the carbon ribbon roll 300 can be properly driven by the printing mechanism 220 of the barcode printer 200 to correctly feed the carbon ribbon for printing barcodes.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A carbon ribbon shaft for a barcode printer, comprising:

a shaft rod having a base section at a first end for coupling to a housing of the barcode printer, and an opposing second end with an internally threaded bore formed therein;

at least one first rotation member fit over an end section of the shaft rod adjacent the first end thereof and having an outer surface forming a plurality of first sliding-resistant resilient tabs, the first rotation member having a first axial bore formed therein, and the first rotation member containing a first resilient member located within the first axial bore between an inside of the first rotation member and the shaft rod;

at least one second rotation member fit over an opposite end section of the shaft rod adjacent the second end thereof and having an outer surface forming a plurality of second sliding-resistant resilient tabs, the outer surfaces of the first and second rotation members receiving a carbon ribbon roll thereon; and a threaded fastener being threadedly engaged with the internally threaded bore and securing the second rotation member to the shaft rod for rotation therewith.

2. The carbon ribbon shaft as claimed in claim 1, wherein the second rotation member has a second axial bore formed therein.

3. The carbon ribbon shaft as claimed in claim 2, wherein the second rotation member contains a second resilient member located within the second axial bore between an inside of the second rotation member and the shaft rod.

* * * * *